US006829894B2

(12) United States Patent
Bloch et al.

(10) Patent No.: US 6,829,894 B2
(45) Date of Patent: Dec. 14, 2004

(54) CLOSED CIRCUIT STEAM ENGINE

(75) Inventors: Carsten Bloch, Berlin (DE); Detlef Wüsthoff, Berlin (DE)

(73) Assignee: Enginion AG, Berlin (DE)

( * ) Notice: Subject to any disclaimer, the term of this patent is extended or adjusted under 35 U.S.C. 154(b) by 0 days.

(21) Appl. No.: 10/606,111

(22) Filed: Jun. 26, 2003

(65) Prior Publication Data

US 2004/0050050 A1 Mar. 18, 2004

(30) Foreign Application Priority Data

Jun. 27, 2002 (DE) ..... 102 28 868

(51) Int. Cl.[7] ..... F01K 13/02
(52) U.S. Cl. ..... 60/646; 60/657
(58) Field of Search ..... 60/646, 657

(56) References Cited

U.S. PATENT DOCUMENTS 5,087,508 A * 2/1992 Beck ..... 428/195.1

FOREIGN PATENT DOCUMENTS

DE 4140828 * 6/1993
GB 2053429 * 2/1981

* cited by examiner

*Primary Examiner*—Hoang Nguyen
(74) *Attorney, Agent, or Firm*—James Creighton Wray; Meera P. Narasimhan

(57) ABSTRACT

The invention concerns a device to generate mechanical work with a steam engine that works with a closed circuit and that has a feed water tank, a feed pump, an evaporator to generate steam, the steam engine, and a condenser. The invention is based on the problem of keeping a device of the initially cited kind free of damage from freezing water when the device is not operating and the environmental temperatures are low. To this end, an inert gas in the feed water tank (10) is used to expel the feed water from the other part (36) of the circuit to the feed water tank (10). This is done by switching a valve arrangement. The feed water tank (10) is designed so that it will not be damaged, for example by exploding from freezing water inside. The advantages of the closed circuit are retained. To restart the device, the system is reheated, and the valve arrangement only has to be switched back to the position suitable for normal operation.

7 Claims, 3 Drawing Sheets

CLOSED CIRCUIT STEAM ENGINE

This application claims the benefit of German Application No. 102 28 868.2 filed Jun. 27, 2002.

BACKGROUND OF THE INVENTION

The invention concerns a device to generate mechanical work with a steam engine that operates with a closed circuit and that has a feed water tank, a feed pump, an evaporator to generate steam, the steam engine, and a condenser.

There are prior art devices of this kind in which the evaporator is heated by hot exhaust from a burner. This evaporator is supplied feed water through the feed pump from a feed water tank. The feed water is evaporated and superheated. This superheated steam is fed to a steam engine. In a prior art device of this kind, the steam engine is a rotary piston engine in the form of a vane motor. The expanded steam leaving the steam engine is condensed in a condenser. The condensed water is then re-supplied to the feed water tank. This device therefore operates in a closed steam/water circuit. The advantage of such devices is that they release very few pollutants with suitable burners.

Areas of application for such devices that simultaneously generate heat and mechanical work can be auxiliary power units that provide heat or power for auxiliary heating or any power consumer, for example when the prime mover of a vehicle is not operating (passenger car, truck, trailer, boat, yacht, etc.).

A problem with such mobile units, especially those that use water as the working fluid, is frost protection. Such units are sometimes used at low environmental temperatures. It must therefore be ensured that the different parts of the closed circuit are not damaged when the water in the closed circuit freezes while the unit is not operating.

In vehicles with internal combustion engines, the coolant water is kept from freezing by adding antifreeze. This antifreeze lowers the freezing point of the coolant water. The coolant water is not a working fluid of that kind of engine. The coolant water remains fluid in the secondary coolant circuit while the internal combustion engine is operating. The temperature remains under 100° C./212° F. At these temperatures, conventional antifreezes remain stable. However, water is the operating medium of a steam engine. The water is evaporated. Temperatures of up to 900° C./1650° F. may arise. At such temperatures, conventional antifreezes decompose. In addition, the water or steam flow as the operating medium through the active parts of the device, evaporator and steam engine. Problems with corrosion and deposits can arise.

It is prior art to drain pipe systems that can freeze, such as garden pipes in the winter. It is however not practical to drain the water from the system of a device of the above-cited kind. The system would have to be refilled with water each time it was started. This would negate the advantage of the closed circuit. Fresh water contains minerals that form scale deposits when the water evaporates.

DISCLOSURE OF THE INVENTION

The invention is based on the problem of keeping a device of the initially cited kind free of damage from freezing water when the device is not operating under low environmental temperatures.

The invention solves this problem in that (a) the feed water tank has an inert gas area above the feed water (b) the feed water tank is designed to be frost-resistant (c) a valve arrangement is provided that can switch the device to a state in which the feed water is expelled from at least the frost-sensitive parts of the circuit by inert gas and moved into the feed water tank According to the invention, an inert gas in the feed water tank is used to expel the feed water from the other part of the circuit to the feed water tank. This is done by switching a valve arrangement. The feed water tank is designed so that it will not be damaged, for example by exploding, from freezing water inside. The advantages of the closed circuit are retained. To restart the device, the system is reheated, and the valve arrangement only has to be switched back to the position suitable for normal operation.

A situation may arise in which residual water remaining in parts of the circuit after expulsion freezes and causes damage as it expands. In another embodiment of the invention, it is therefore provided that the inert gas is a substance such as xenon that forms a gas hydrate with water.

There are gaseous substances that do not dissolve in water but form a gas hydrate with water at low temperatures. Gas hydrates are not genuine compounds. The gas such as xenon is instead enclosed by the water molecules in an ice-like structure. It has been demonstrated that such frozen gas hydrates exert substantially less pressure on surrounding walls than normal ice. Even relatively weak structures such as glass tubes can withstand the pressure exerted by freezing gas hydrates. By using a substance as the inert gas that forms such a gas hydrate which also expels water from the system under pressure, the remaining water in the system forms a gas hydrate whose pressure does not damage the parts of the circuit upon freezing.

In the following description, a switching sequence is also described for the otherwise unchanged valve arrangement in which the water is not expelled from the circuit into the feed water tank but rather the water is only enriched with the inert gas forming the gas hydrate.

In an embodiment of the invention, the feed water tank is connectable via the valve arrangement with a variable volume feed water reservoir. In a first valve state of the valve arrangement, the circuit that runs from the feed water tank via the feed pump, the evaporator, steam engine and the condenser back to the feed water tank is closed, In a second valve state of the valve arrangement, the water from the reservoir can be fed to the feed water tank by the feed pump to generate overpressure from the inert gas in the system comprising the evaporator, steam engine and the condenser. In a third valve state of the valve arrangement, the feed water tank is separated from the circuit and connected to the reservoir to release pressure, and in a fourth valve state of the valve arrangement, the system under pressure is connected with the de-pressurized feed water tank. An overpressure can be maintained in the system in a fifth valve state of the valve arrangement. The circuit has a first pipe section between the part of the feed water tank filled with feed water and the feed pump in which ends a connecting line to the reservoir with a changeable volume. The circuit has a second pipe section between the feed pump and the evaporator. The circuit has a third pipe section between the condenser and the inert gas area filled with inert gas above the water surface of the feed water tank. A fourth pipe section extends between the inert gas area of the feed water tank and the second pipe section. The valve arrangement has a first and second controllable in-line valve that are in the first pipe section, whereby the connecting line ends at the reservoir between these valves. The valve arrangement has a third and fourth controllable in-line valve that are in the second pipe section, whereby the fourth pipe section is connected between these valves to the second pipe section. The valve arrangement has a fifth valve that is in the fourth pipe section. The valve arrangement has a sixth valve that is in the third pipe section. Finally, the valve arrangement has a seventh valve that is in the connecting line to the reservoir with a variable volume. In the first valve state of the valve arrangement, the first, second, third, fourth, and sixth valves are open, and the other valves are closed. In the second valve state of the valve arrangement, the second, third, fifth and sixth valves are open, and the other valves are closed. In the third valve state of the valve arrangement, the first and seventh valves are open, and the other valves are closed, and in the fourth valve state of the valve arrangement, the fourth and fifth valves are open, and the other valves are closed.

Exemplary embodiments of the invention are further explained below with reference to the associated drawings.

DESCRIPTION OF PREFERRED EMBODIMENTS

Figure 1:
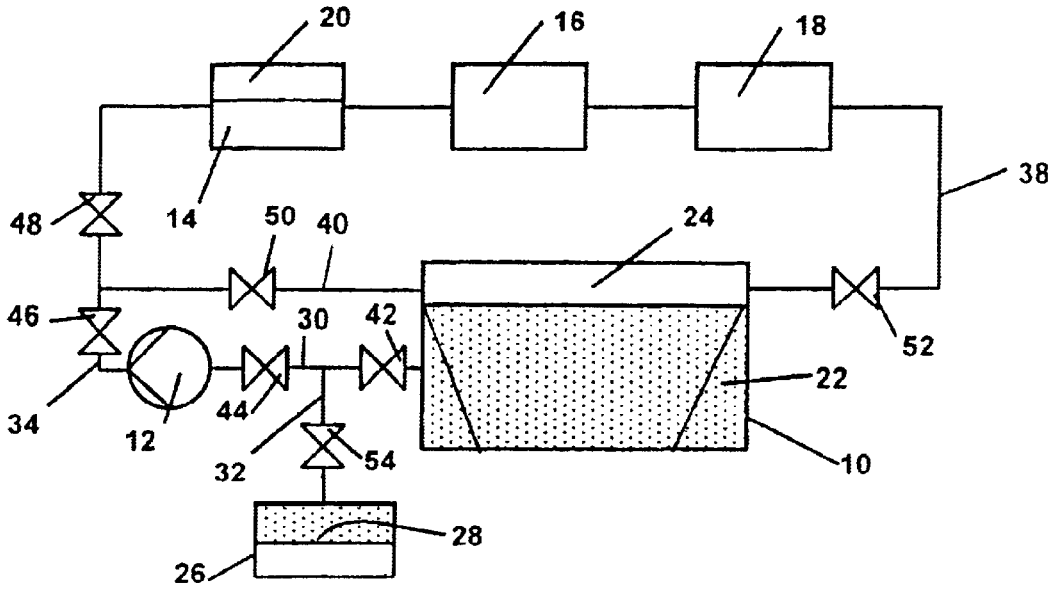
FIG. 1 is a schematic representation of a device to generate mechanical work with a steam engine that works with a closed circuit of water, the working medium, whereby measures are taken with a valve arrangement to protect from frost.

FIG. 1 schematically illustrates a device to generate mechanical energy with a steam engine. The device contains a feed water tank 10 in a closed circuit, a feed pump 12, an evaporator 14, a steam engine 16 and a condenser 18. The condenser 18 is connected to the feed water tank. The feed pump 12 pumps feed water from the feed water tank 10 into the evaporator 14. The evaporator is heated by a burner 20 and evaporates the feed water. This strongly overheats the steam. The steam can reach temperatures of approximately 900° C./1650° F. The highly compressed steam powers the steam engine 16. The steam engine can be a rotary piston engine e.g. in the form of a vane motor. The steam expands in the steam engine and releases mechanical work. The expanded steam flows to the condenser 18 where it is cooled and condensed. The condensed water flows back to the feed water tank 10. The circuit normally also includes various heat exchangers that are omitted here for the sake of simplicity. Furthermore, the circuit contains various sections of piping between the various components.

The feed water tank 10 is sealed. In its bottom part 22, it holds the supply of feed water. Above the feed water in the feed water tank 10 is an inert gas area 24. This inert gas area 24 above the surface of the feed water contains an inert gas. In the present case, the inert gas is xenon. Xenon is a noble gas. It has the property of forming a gas hydrate with water under a pressure of 150 kPa. This is not a chemical compound. Rather, xenon gas, is held between the water molecules in a specific structure. The feed water tank is designed to be frost-resistant so that it is not damaged from freezing water inside, for example by exploding. This can be accomplished, for example, by giving the feed water tank a suitable shape, for example one that narrows downward as indicated so that the forming ice can escape upward when it expands.

Figure 3:
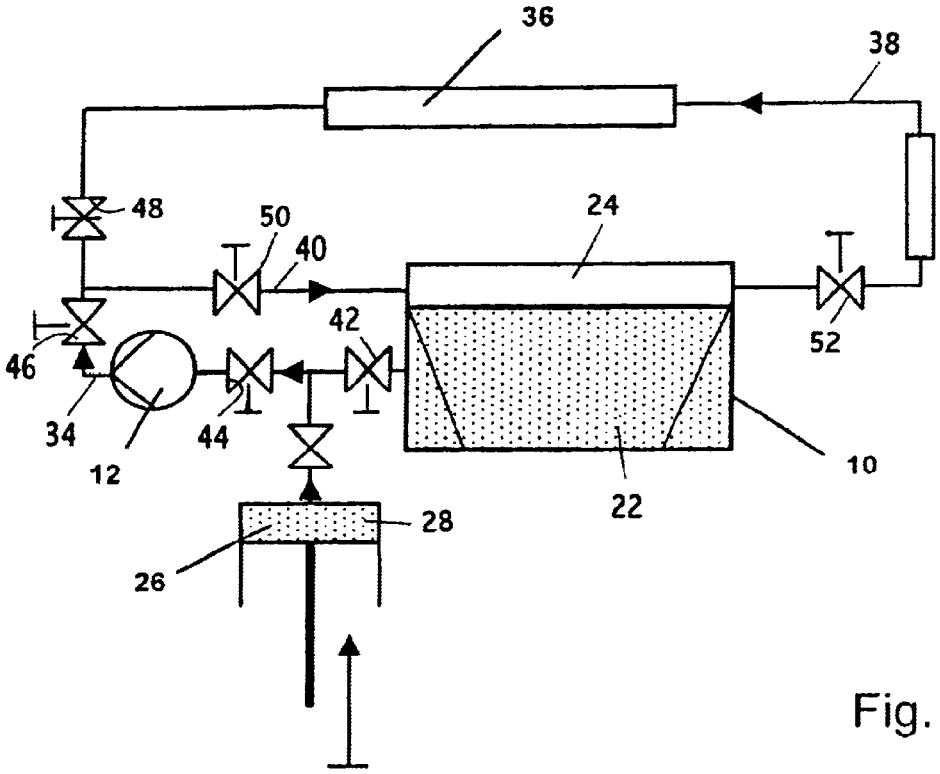
FIG. 3 is a schematic representation similar to FIG. 2 whereby the valve arrangement is in a second switched state in which inert gas from the feed water tank is expelled by the feed pump into the system consisting of the evaporator, steam engine and condenser, and pressure forms in this system from the inert gas.
Figure 4:
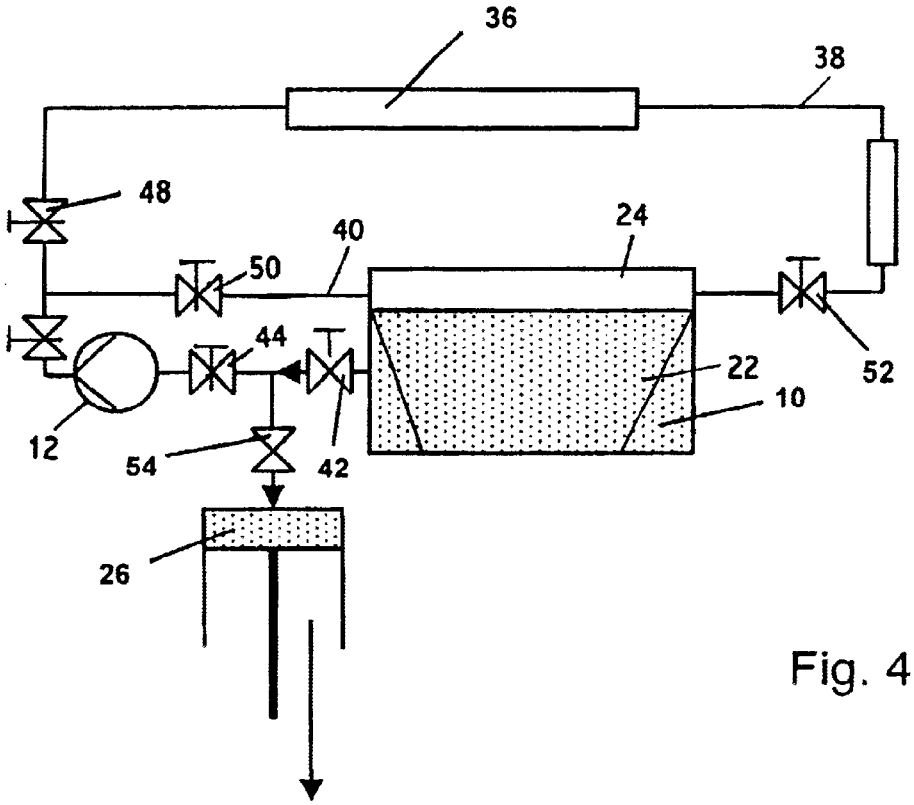
FIG. 4 is a schematic representation similar to FIG. 2 whereby the valve arrangement is in a third switched state in which the feed water tank is separate from the other system and is depressurized.
Figure 5:
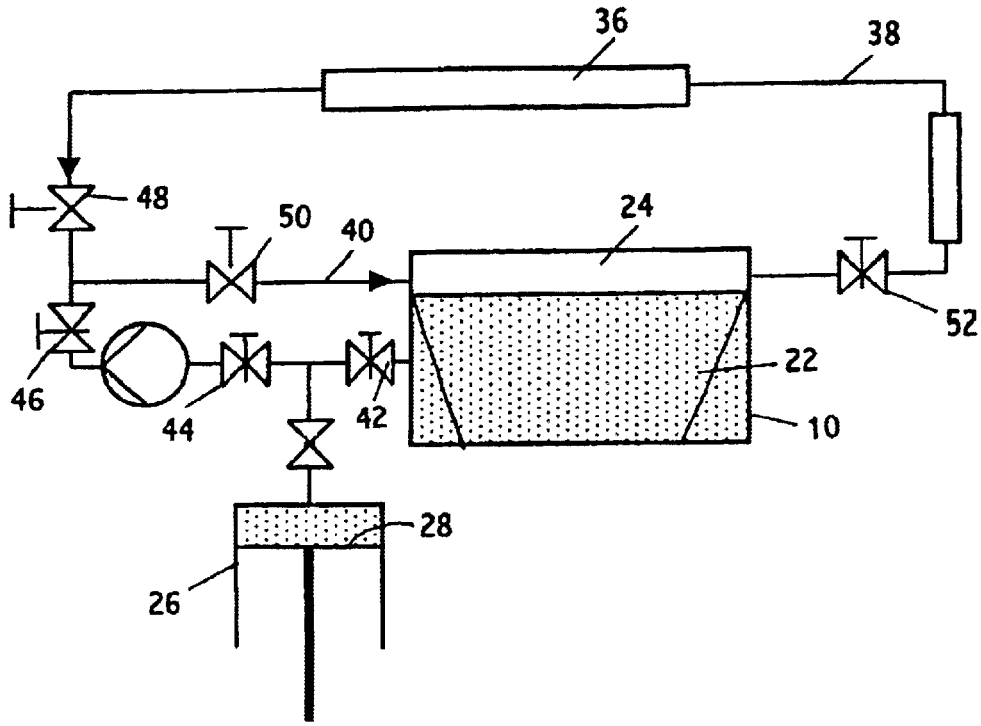
FIG. 5 is a schematic representation similar to FIG. 2 whereby the valve arrangement is in a fourth valve state in which water is expelled by the built-up pressure from the inert gas out of the system consisting of the evaporator, steam engine and condenser and into the depressurized feed water tank.

In addition to the feed water tank 10, there is a reservoir 26 with a changeable volume. As indicated in FIGS. 3 and 4, the reservoir 26 has a movable wall 28. The reservoir is therefore under atmospheric pressure (or another settable pressure) arising from the movable wall 28.

The circuit has a first pipe section 30 between the part 22 of the feed water tank 10 filled with feed water and the feed pump 12. A connecting line 32 to the volume-changing reservoir 26 ends in pipe section 30. The circuit has a second pipe section 34 between the feed pump 12 and the system containing the evaporator 14 that is generally identified in FIGS. 2–6 with the number 36. The circuit has a third pipe section 38 between the condenser 18 and the inert gas area 24 of the feed water tank 10. A fourth pipe section 40 extends between the inert gas area 24 of the feed water tank 10 and the second pipe section 34.

The device has a valve arrangement that will be described in detail. The valve arrangement contains numerous controllable valves. The valves are controllable by a controller to assume different "patterns." These patterns will be termed "valve states" of the valve arrangement in the following.

In a first valve state of the valve arrangement, the circuit that runs from the feed water tank 10 via the feed pump 12, the evaporator 14, steam engine 16 and the condenser 18 back to the feed water tank 10 is closed. This is the normal operational position. In a second valve state of the valve arrangement, the water from the reservoir 26 is fed to the feed water tank 10 by the feed pump 12 to generate overpressure from the inert gas in the system 36. In a third valve state of the valve arrangement, the feed water tank 10 is separated from the circuit and connected to the reservoir 26 to release pressure. In a fourth valve state, the circuit under pressure is connected to the de-pressurized feed water tank 10.

When the device is turned off and a temperature sensor indicates a frost hazard, the valve arrangement is sequentially switched by a control device from the first valve state to the second valve state, then into the third valve state and finally from the third valve state to the fourth valve state. This generates an overpressure in the system 36 from the inert gas. Then the feed water tank 10 is separated from the system 36, and the pressure is relieved. Finally, the feed water tank 10 on the other side of the system 36 is connected to the system 36. The pressurized inert gas then presses the water out of the system 36 into the de-pressurized feed water tank 10. The necessary overpressure is generated for the formation of a gas hydrate by repeating the second valve state and then closing all valves.

The valve arrangement is constructed as follows:

The valve arrangement has a first and second controllable in-line valve 42 and 44 that are in the first pipe section 30. The connecting line 32 to the reservoir 26 ends between these valves. The valve arrangement has a third and fourth controllable in-line valve 46 and 48 that are in the second pipe section 34. Between these valves 46 and 48, the fourth pipe section 40 is connected to the second pipe section 34. The valve arrangement has a fifth valve 50 that is in the fourth pipe section 40. The valve arrangement has a sixth valve 52 that is in the third pipe section 38. Finally, the valve arrangement has a seventh valve 54 that is in the connecting line 32 to the reservoir 26 with the changeable volume.

The different valve states of the valve arrangement are shown in FIGS. 2–5. The valves are symbolized by a "T" at the various pipe sections. When the vertical line of the "T" intersects the relevant pipe section, it means that the valve is closed. When the vertical line of the "T" is next to the pipe section, it means that the valve is open.

Figure 2:
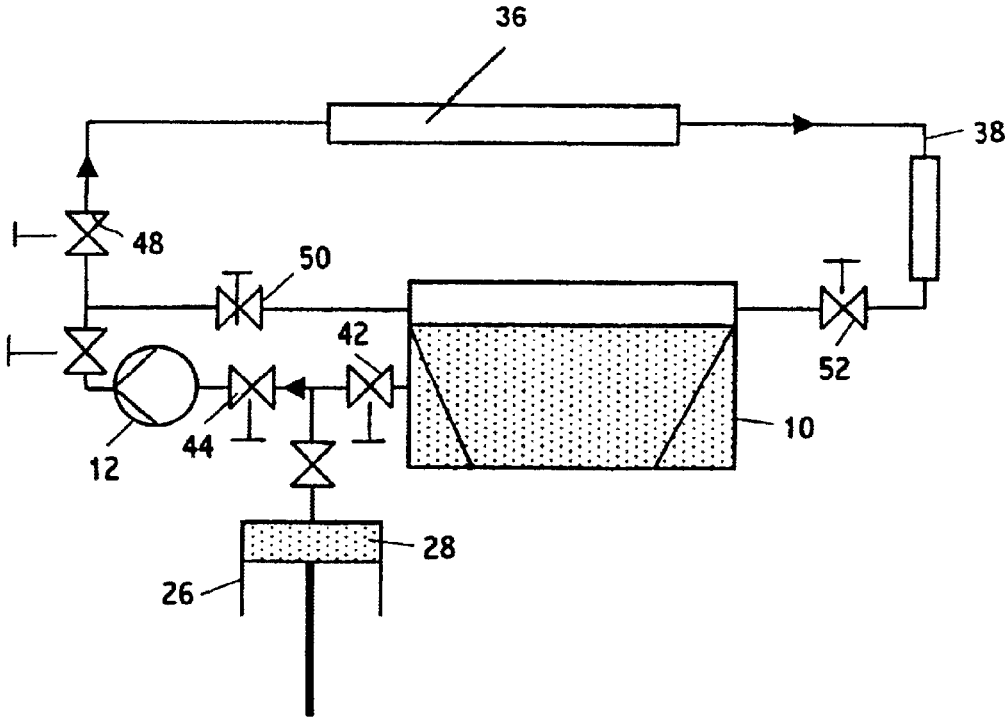
FIG. 2 is a schematic representation of the device similar to FIG. 1 in which the valve arrangement is switched to a state for normal operation of the device.

In the first valve state of the valve arrangement from FIG. 2, the first, second, third, fourth, and sixth valves 42, 44, 46, 48, and 52 are open, and the other valves are closed. In the second valve state of the valve arrangement from FIG. 3, the second, third, fifth, sixth and seventh valves 44, 46, 50, 52 and 54 are open, and the other valves are closed. This causes pressure to rise in the system 36 from the inert gas as water is supplied from the reservoir 26 into the feed water tank 10, and the water is pressurized by the feed pump 12. On the left side in FIG. 3, the system 36 is blocked by a valve 48. The flow directions are indicated by arrows. In the third valve state of the valve arrangement in FIG. 4, the first and seventh valves 42 and 54 are open, and the other valves are closed. The pressure is then balanced between the feed water tank 10 and reservoir as indicated by arrows. The system 36 is closed on both sides by valves 48 and 52. In the fourth valve state of the valve arrangement in FIG. 5, the fourth and fifth valves 48 and 50 are open, and the other valves are closed. The water is then expelled from the system 36 by the inert gas into the feed water tank 10, as indicated by the arrows.

This series of valve states of the valve arrangement transfers at least a majority of the water from the system 36 into the feed water tank 10. As describe above, the feed water tank 10 is designed so that it cannot be damaged by freezing water. To restart the device, the valve arrangement only needs to be returned to the first valve state. Then water can be pumped by the feed pump 12 from the feed water tank 10 into the circuit.

By using xenon (or a similar gas that forms a gas hydrate) as the inert gas, an additional effect is attained. Residual water that cannot be expelled by the inert gas into the feed water tank 10 can still damage parts of the system 36 when it freezes. Such residual water forms a gas hydrate with xenon. As mentioned, such a gas hydrate exerts substantially less pressure on the walls when it freezes than pure ice. Since the majority of the water is pressed out of the system 36 and only residual water at most remains in the system 36, only relatively small amounts of xenon are necessary to form the gas hydrate.

Figure 6:
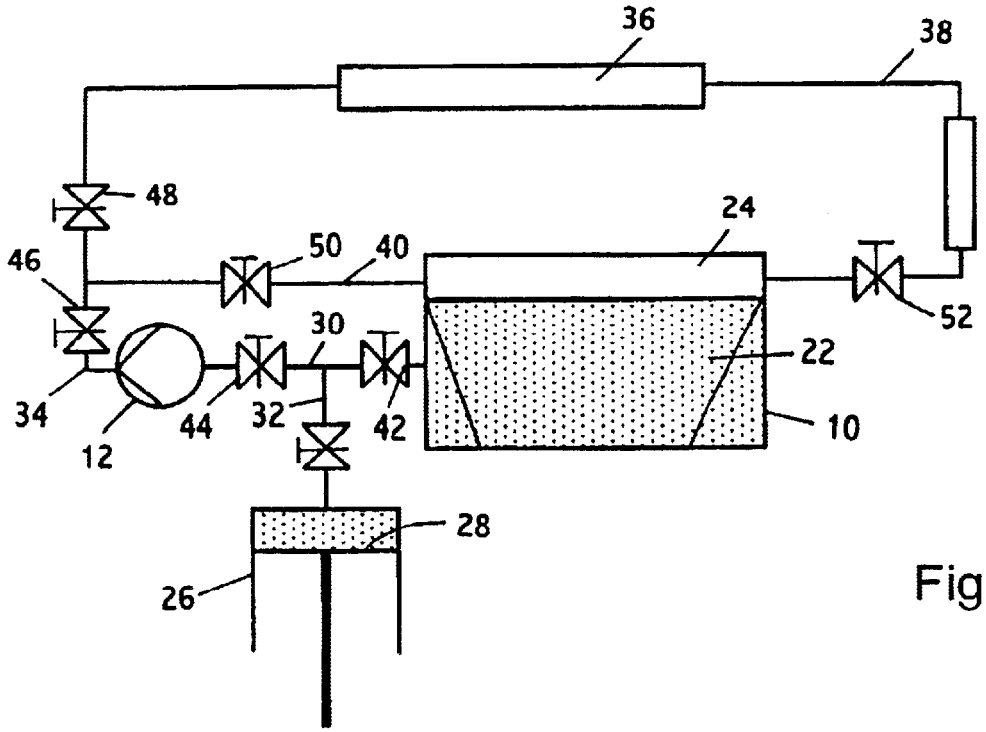
FIG. 6 shows an altered use of the valve arrangement in FIG. 1 in which frost protection is achieved exclusively by an inert gas in the system that forms a gas hydrate.

The valve arrangement described in conjunction with FIG. 1 can be used so that the water is not expelled from the system 36 but rather is prevented from damaging the system 36 by forming a gas hydrate when it freezes when xenon is used as the inert gas. This is shown in FIG. 6.

The valve arrangement is changed from the valve state in FIG. 2 to the valve state in FIG. 3. Then, as described, pressure is generated in the system 36 by the inert gas, i.e., xenon. From this valve state, the valve arrangement in FIG. 6 is changed to the valve state in which all valves are closed. When the water freezes, a gas hydrate forms in the system 36 from the water and the xenon. The pressure of this gas hydrate can be absorbed by the walls of the system.

We claim:

1. A device for generating mechanical work by means of a steam engine in a closed circuit, said closed circuit comprising in series a feed water tank, a feed pump, an evaporator, said steam engine and a condenser, said feed pump drawing water from said feed water tank and feeding this water to said evaporator, steam under pressure from said evaporator being fed as working medium to said steam engine, exhaust steam from said steam engine being condensed by said condenser and returned to said feed water tank, frost-sensitive parts of said closed circuit being prone to be damaged by frost, wherein said feed water tank is of frost resistant design, water in said feed water tank has a water surface, said feed water tank defining a gas space above said water surface, said gas space being filled with a gas, and further comprising means for expelling, by means of said gas, feed water from, at least, the frost-sensitive parts of the circuit and for pressing said expelled feed water into said frost resistant feed water tank.

2. A device as claimed in claim 1, wherein said expelling means comprise:

a variable volume feed water reservoir and valve means having first, second, third and forth valve states for determining interconnections in said closed circuit, in said first valve state of said valve means, the circuit from feed water tank via feed pump, evaporator, steam engine and condensor back to the feed water tank being closed for normal operation in said second valve state of said valve means, the feed pump is connected to feed water from said feed water reservoir to said feed water tank, thereby pressurizing said gas in a system comprising said evaporator, said steam engine and said condenser, in said third valve state of said valve means, said feed water tank is separated from the remainder of the circuit and is connected to said variable volume reservoir to release the pressure built up therein, and in said fourth valve state of said valve means, said system being connected to said de-pressurized feed water tank, whereby said pressurized gas flushes water contained in said system into said feed water tank, and valve control means for causing said valve means to assume one of said first, second, third and forth valve state.

3. A device as claimed in claim 2, wherein said valve means have a fifth valve state, in which said gas is kept pressurized in said system.

4. A device as claimed in claim 2, wherein said circuit comprises a first pipe section communicating, on one hand, with said feed water tank below said water surface and, on the other hand, with said feed pump, and further comprises a connecting pipe communicating said first pipe section with said variable volume reservoir, said circuit comprising a second pipe section connecting said feed pump and said evaporator a third pipe section communicates, on one hand, with the condensor and, on the other hand, with said gas space above said water surface of said feed water tank, a fourth pipe section communicates with said gas space above said water surface, on one hand, and with said second pipe section, on the other hand, said valve means comprise:

first and second controllable valves arranged in series in said first pipe section, said connecting line opening into said first pipe section between said first and second controllable valves, third and fourth controllable valves arranged in series in said second pipe section, said fourth pipe section communicating with said second pipe section between said third and fourth controllable valves, a fifth controllable valve arranged in said forth pipe section, a sixth controllable valve arranged in said third pipe section, and a seventh controllable valve arranged in said connecting pipe communicating said first pipe section with said variable volume reservoir, said valve control means are operative:

in said first valve state of said valve means to open said first, second, third forth and sixth valves, the remaining valves being closed, in said second valve state of said valve means, to open said second, third, fifth sixth and seventh valves, the remaining valves being closed, in said third valve state of said valve means, to open said first valve and said seventh valve, the remaining valves being closed, in said fourth valve state of said valve means, to open said forth valve and said fifth valve, the remaining valves being closed.

5. A device as claimed in claim 1, wherein said gas is a gas of the type forming a gas hydrate with water.

6. A device as claimed in claim 5, wherein said gas is xenon.

7. A device for generating mechanical work by means of a steam engine in a closed circuit, said closed circuit comprising in series a feed water tank, a feed pump, an evaporator, said steam engine and a condenser, said feed pump drawing water from said feed water tank and feeding this water to said evaporator, steam under pressure from said evaporator being fed as working medium to said steam engine, exhaust steam from said steam engine being condensed by said condenser and returned to said feed water tank, frost-sensitive parts of said closed circuit being prone to be damaged by frost, wherein water in said feed water tank has a water surface, said feed water tank defining a gas space above said water surface, said gas space being filled with a gas, of the type forming a gas hydrate with water, said circuit comprises a first pipe section communicating, on one hand, with said feed water tank below said water surface and, on the other hand, with said feed pump, and further comprises a connecting pipe communicating said first pipe section with said variable volume reservoir, said circuit comprising a second pipe section connecting said feed pump and said evaporator a third pipe section communicates, on one hand, with the condenser and, on the other hand, with said gas space above said water surface of said feed water tank, a fourth pipe section communicates with said gas space above said water surface, on one hand, and with said second pipe section, on the other hand, valve means have first, second, and fifth valve states for determining interconnections in said closed circuit, valve control means are provided for causing said valve means to assume one of said first, second, third and forth valve states, said valve means comprising first and second controllable valves arranged in series in said first pipe section, said connecting line opening into said first pipe section between said first and second controllable valves, third and fourth controllable valves arranged in series in said second pipe section, said fourth pipe section communicating with said second pipe section between said third and fourth controllable valves, a fifth controllable valve arranged in said forth pipe section, a sixth controllable valve arranged in said third pipe section, and a seventh controllable valve arranged in said connecting pipe communicating said first pipe section with said variable volume reservoir, said valve control means are operative:

in said first valve state of said valve means to open said first, second, third forth and sixth valves, the remaining valves being closed, in said second valve state of said valve means, to open said second, third, fifth and sixth valves, the remaining valves being closed, in said fifth valve state of said valve means to close all valves, and, when the device is to be shut down, to switch said valve means from said first valve state, first, into said second valve state.

* * * * *